United States Patent [19]

Pickering

[11] 3,950,018

[45] Apr. 13, 1976

[54] BOLT LOCKS FOR FREIGHT CAR, TRAILER TRUCK AND AIR CARGO DOORS

[76] Inventor: John J. Pickering, 102 Barrett Ave., North Providence, R.I. 02904

[22] Filed: Oct. 20, 1972

[21] Appl. No.: 299,201

[52] U.S. Cl. ..... 292/144; 292/DIG. 32

[51] Int. Cl.[2] ..... E05C 1/06

[58] Field of Search ..... 292/144, 172, 201, DIG. 32

[56] References Cited

UNITED STATES PATENTS

| | | | |
|---|---|---|---|
| 2,709,610 | 5/1955 | Chandler | 292/144 |
| 2,997,752 | 8/1961 | Henrikson et al. | 292/DIG. 32 |
| 3,295,878 | 1/1967 | Houvener | 292/144 |

*Primary Examiner*—H. Hampton Hunter

*Attorney, Agent, or Firm*—Berman, Aisenberg & Platt

[57] ABSTRACT

Anti-tampering bolt locking devices for hinged or sliding railway freight car or for other freight vehicle doors. The bolt locking devices may consist of air pressure or electromagnetically controlled bolt detents which may be either locally or remotely operated. The bolts may be directly operated by air pressure cylinders. Compressed air cartridges may be employed as the compressed air source. The cartridges may contain small quantities of lubricant such as graphite, or the like.

7 Claims, 22 Drawing Figures

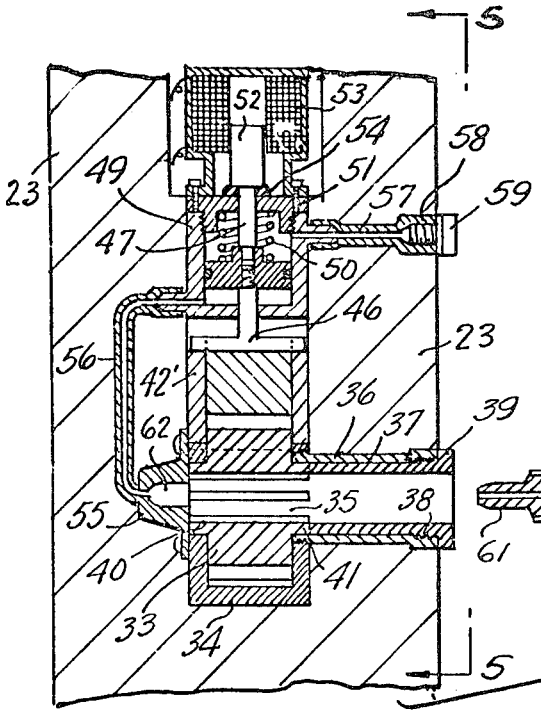
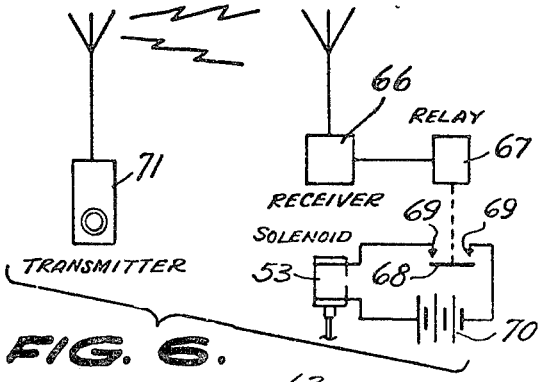
FIG. 6.
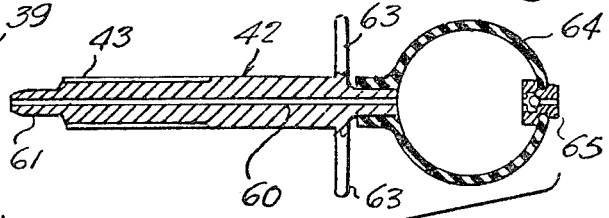
FIG. 3.
FIG. 4.
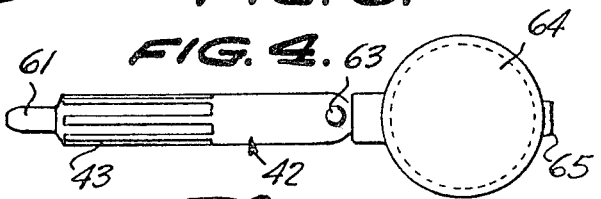
FIG. 5
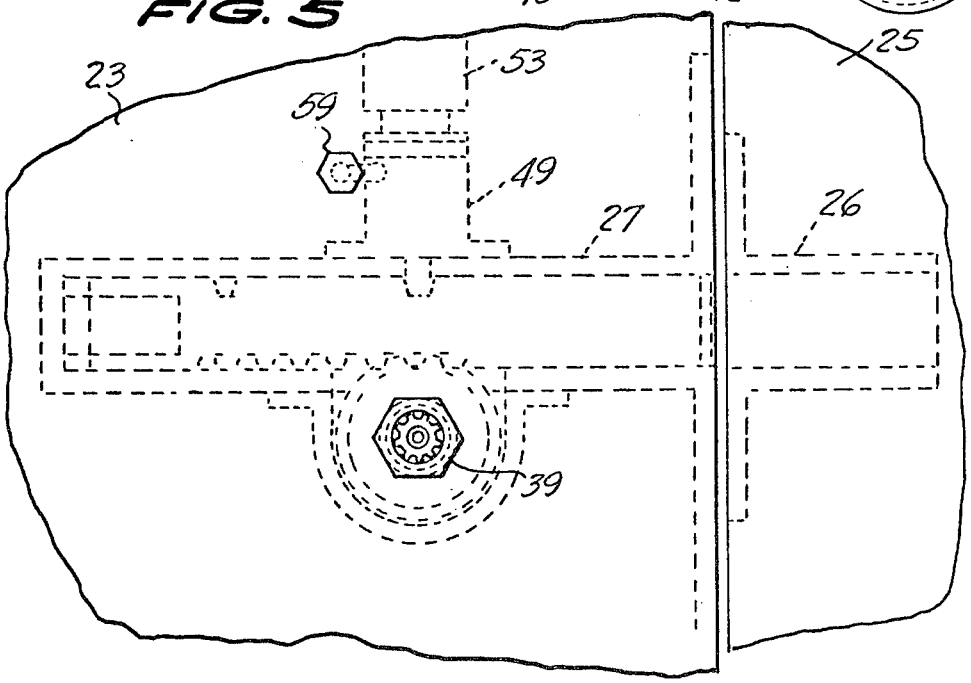

FIG. 12.
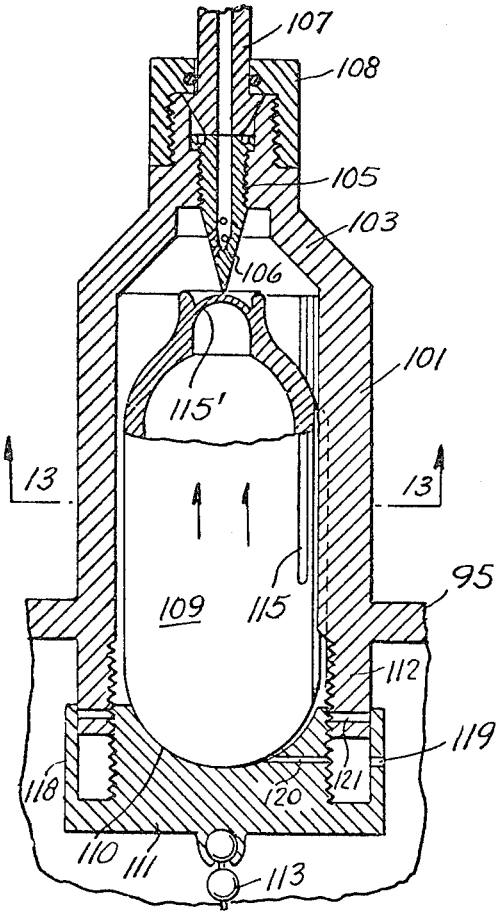
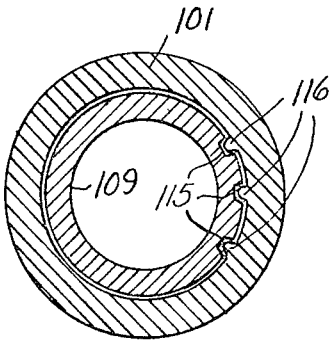
FIG. 13.
FIG. 14.
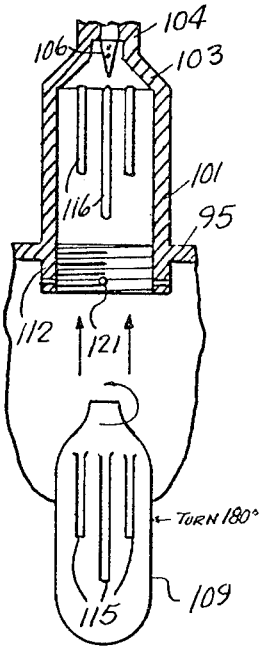
FIG. 15.
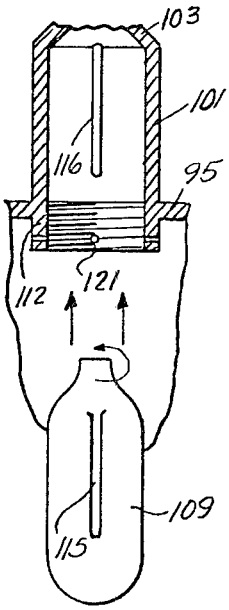
FIG. 16.
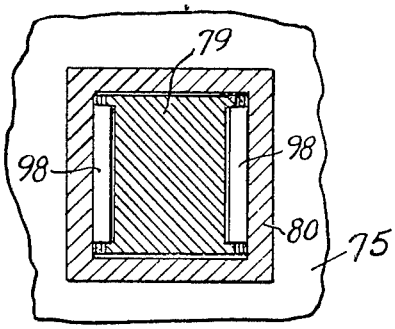
FIG. 17.
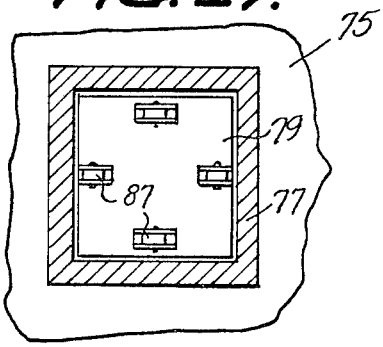

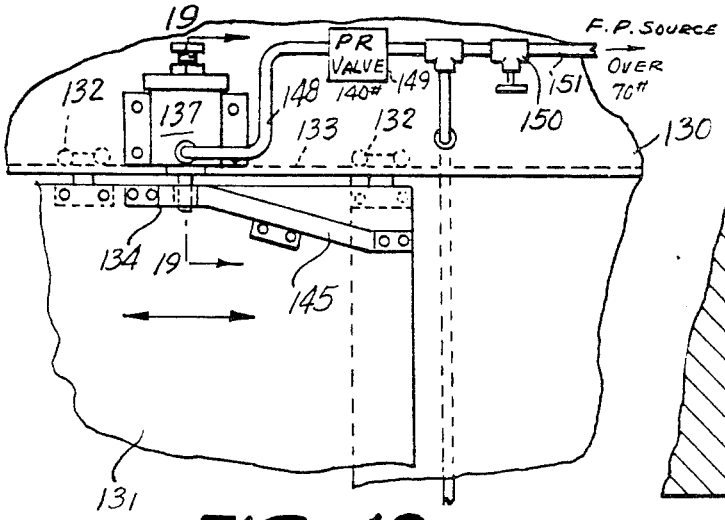
FIG. 18.
FIG. 19.
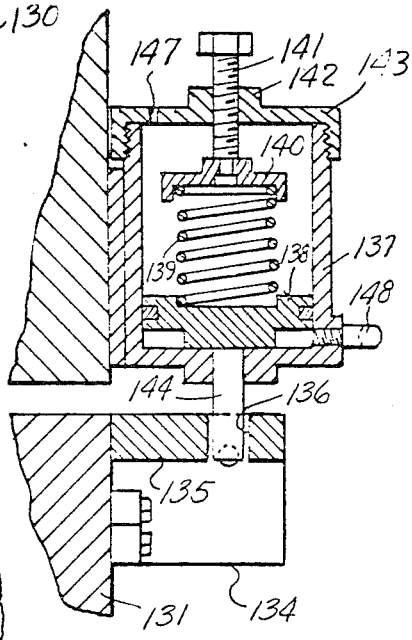
FIG. 20.
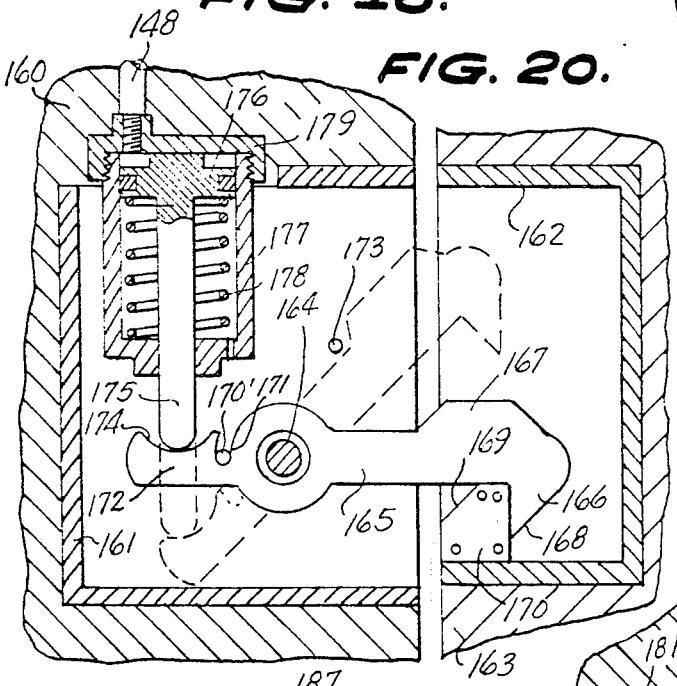
FIG. 21.
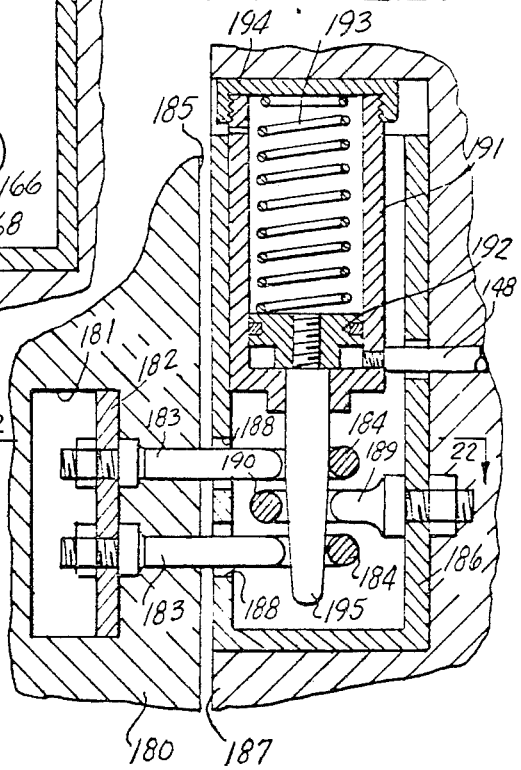
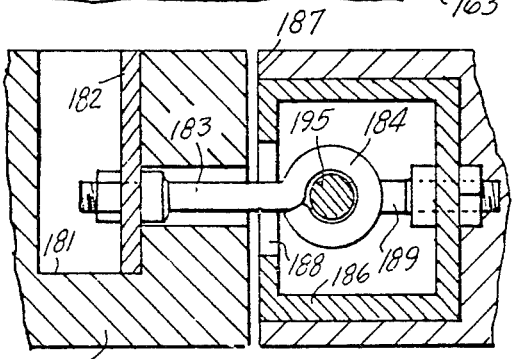
FIG. 22.

BOLT LOCKS FOR FREIGHT CAR, TRAILER TRUCK AND AIR CARGO DOORS

This invention relates to car door locking devices, and more particularly, to tamper-proof bolts and bolt locking devices for railway freight car doors or other freight vehicle doors.

A main object of the invention is to provide novel and improved anti-tampering bolt locking devices for hinged or sliding freight vehicle doors, the bolt locking devices being of simple construction, being relatively easy to install, and providing protection against tampering with the bolts associated therewith and thereby preventing unauthorized opening of the doors provided with such devices.

A further object of the invention is to provide improved tamper-proof bolt locking devices for freight vehicle doors, said devices being inexpensive to manufacture, being durable in construction, and being very reliable in operation.

A still further object of the invention is to provide improved anti-tampering bolt locking devices for hinged or sliding railway car doors or other freight vehicle doors, said devices being adapted either for air pressure operation or for operation by electromagnetic means, and being further adapted for either local operation or by remote control.

Further objects and advantages of the invention will become apparent from the following description and claims and from the accompanying drawings, wherein:

FIG. 1 is a horizontal cross-sectional view taken through the marginal portion of a hinged freight car door and a portion of the adjacent doorway, showing an improved anti-tampering device according to the present invention employed with the door locking bolt mechanism and illustrating the manner in which the sliding bolt is held in door-locking position by the anti-tampering mechanism of the present invention.

FIG. 3 is a vertical fragmentary cross-sectional view taken substantially on line 3—3 of FIG. 2, but showing an unlocking key device which may be employed with the mechanism, said key device being shown in longitudinal cross-section.

FIG. 4 is a side elevational view of the unlocking key device illustrated in FIG. 3.

FIG. 5 is a fragmentary elevational view taken substantially on line 5—5 of FIG. 3.

FIG. 6 is a diagrammatic view showing a remote control radio system which may be employed to energize the bolt unlocking solenoid of the mechanism shown in FIGS. 1–5.

FIG. 12 is an enlarged fragmentary vertical cross-sectional view taken substantially on line 12—12 of FIG. 10.

FIG. 13 is a horizontal cross-sectional view taken substantially on line 13—13 of FIG. 12.

FIG. 14 is a fragmentary vertical cross-sectional view substantially to the same scale as FIG. 10 and showing a compressed air container in a position preliminary to being inserted in its associated chamber which forms part of the assembly of FIGS. 8–13.

FIG. 15 is a fragmentary vertical cross-sectional view similar to FIG. 14, but showing the use of a modified form of compressed air container, and associated receiving chamber.

FIG. 16 is a horizontal cross-sectional view taken substantially on line 16—16 of FIG. 10.

FIG. 17 is a horizontal cross-sectional view taken substantially on line 17—17 of FIG. 10.

FIG. 18 is a fragmentary elevational view of the upper portion of a freight car door and structural parts of the associated freight car adjacent thereto, the door being of the sliding type and the associated freight car being provided with another form of improved anti-tampering door bolting assembly according to the present invention.

FIG. 19 is an enlarged fragmentary vertical cross-sectional view taken substantially on line 19—19 of FIG. 18.

FIG. 20 is a fragmentary vertical cross-sectional view taken through the vertical marginal portion of a sliding freight side door provided with an improved anti-tampering bolt mechanism according to the present invention, the associated bolt being of the pivoted type and being shown in door-locking position.

FIG. 21 is a fragmentary vertical cross-sectional view taken through the vertical marginal portion of a sliding freight car door and the adjacent vertical marginal portion of the associated doorway, illustrating a further modified form of improved anti-tampering door bolting structure according to the present invention, showing the door in locked position.

FIG. 22 is a horizontal cross-sectional view taken substantially on line 22—22 of FIG. 21.

Figure 1:
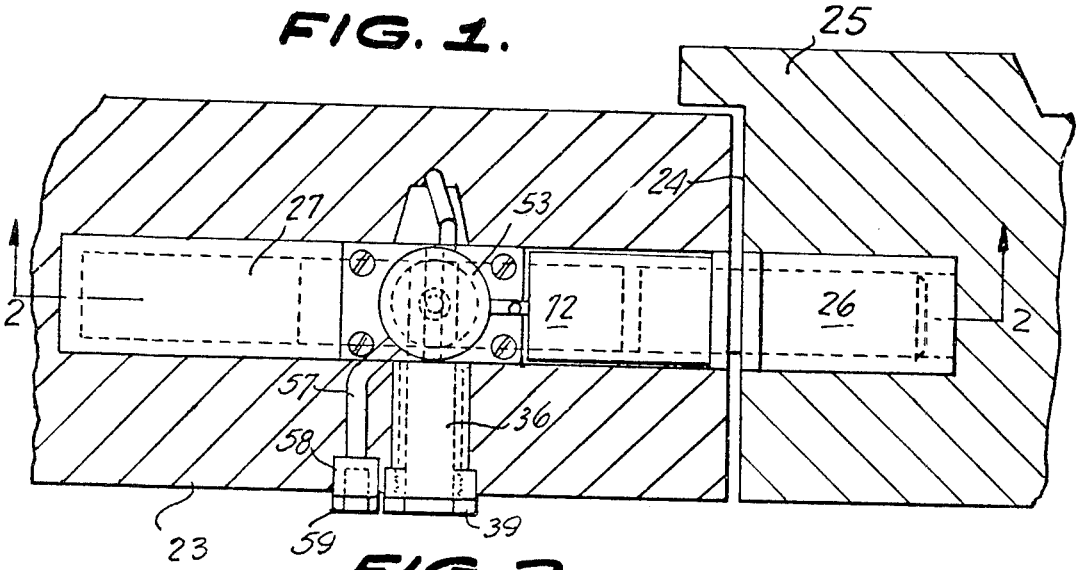
Figure 2:
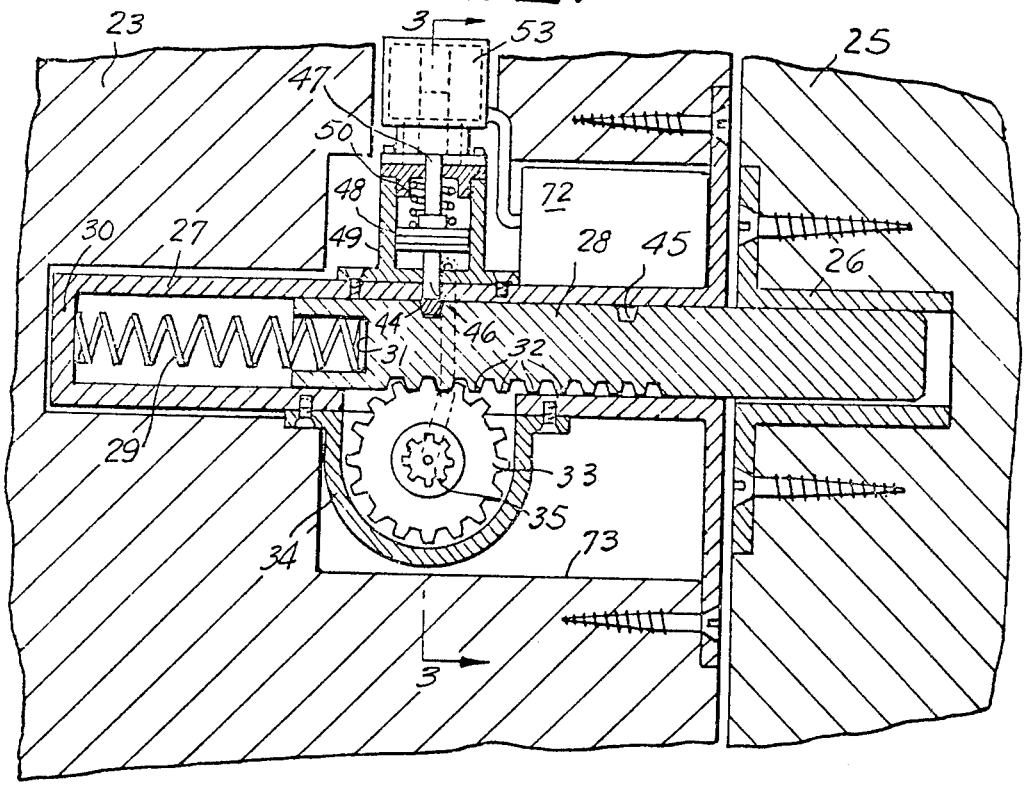
FIG. 2 is a fragmentary vertical cross-sectional view taken substantially on line 2—2 of FIG. 1.

Referring to the drawings, and more particularly to FIGS. 1 through 6, 23 designates a typical hinged door of an enclosure, for example, a freight car or the like, the door 23 being swingable to a closed position such as shown in FIG. 1, wherein the edge portion of the door is received in a recess 24 provided in the margin of the associated doorway member 25. Mounted in the doorway member 25 is a bolt socket 26, and mounted in the door 23 is an elongated housing member 27 which is registrable with the socket 26 when the door 23 is in its closed position, such as that shown in FIG. 1, the housing 27 containing a sliding bolt member 28 which is receivable in the socket 26 in the manner illustrated in FIG. 2 to retain the door 23 in its locked position. The housing 27 contains a coil spring 29 having one end engaged against the inner end wall 30 of housing 27 and having its other end received in a recess 31 provided in the inner end of bolt member 28, whereby to bias the bolt member toward its extended position.

The bolt 28 is formed at its bottom portion with transverse rack teeth 32 which are meshingly engaged by a pinion gear 33 rotatably mounted in a transversely extending housing 34, the housing 34 having a semi-cylindrical bottom wall portion generally conforming to the shape of the lower portion of pinion gear 33. Pinion gear 33 is provided with a splined axial bore 35 and a guide sleeve 36 is threadedly secured to housing 34 in axial alignment with the bore 35, the sleeve 36 extending to the outside of door 23. A removable inner sleeve 37 is engaged in the main sleeve 36 and is threadedly inter engaged therewith, as shown at 38, the inner sleeve 37 being provided with the hexagonal outer flange 39 which is readily engagable by a conventional tool for unscrewing same and removing same when it is desired to remove trash or other interfering contents from the interior of sleeve 37. Pinion gear 33 is provided with respective hub portions 40 and 41 journalled respectively in the inner wall 42 of housing 34 and in the inner end of the fixed sleeve member 36.

As will be presently described, a suitable key having a splined shaft 43 is adapted to be engaged through the sleeve 37 with the splined portion 43 thereof meshing with the splined bore 35 of pinion gear 33 for manually rotating the pinion gear to thereby move locking bolt 28 longitudinally in the guide housing 27.

Locking bolt 28 is provided at its top surface with respective transversely extending locking detent and unlocking detent grooves 44 and 45 adapted to be lockingly engaged by an inverted T-shaped, vertically movable detent member 46 for holding the bolt 28 either in an extended locking position or a retracted unlocking position. Thus, when the vertically movable detent member 46 is interengaged with the transverse detent groove 44, the bolt 28 is locked in its extended position, for example, the position thereof shown in FIG. 2, wherein the bolt is received in the socket 26 and the door 23 is held locked. Under these conditions, the pinion gear 33 cannot be rotated by the key 42 since it is interlocked with the bolt 28. Similarly, when the detent member 46 is interengaged with the groove 45, the bolt 28 is held in its retracted position and pinion gear 33 cannot be rotated by using the key 42.

Detent member 46 is connected to the lower end of a vertical rod member 47 to which is also secured a piston 48 slidably and sealingly engaged in a vertical cylinder 49 secured to the top wall of housing 27, the piston 48 being biased downwardly by a coil spring 50 bearing between piston 48 and a centrally apertured top cover plug 51 provided on cylinder 49. Rigidly secured to the top end of rod 47 is a plunger 52 of a solenoid 53 coaxially mounted on the top of cylinder 49 and being secured to the top cover plug 51 of said cylinder, the plunger 52 being received in the central bore of the solenoid winding, as shown in FIG. 3, the plunger being normally biased into engagement with an annular resilient deformable washer 54 surrounding the relatively reduced rod member 47 below plunger 52.

The inner wall 42' of the gear housing member 34 is provided with a hollow cap 55 which communicates with the spline gear bore 35 and which is connected by a conduit 56 with the lower portion of cylinder 49. The top portion of cylinder 49 has a vent opening connected by a conduit 57 to the outer surface of the door 23, said conduit terminating in an internally threaded outer cup portion 58 which normally receives a threaded plug 59, as shown in FIG. 3. The plug 59 may be manually removed by unscrewing same from the cup member 58, to permit venting of the upper portion of cylinder 49 when it is desired to elevate piston 48 and thereby raise the detent member 46 from its locking position. Plug 59 is also removable when it is desired to elevate the detent member 46 by energizing the solenoid 53.

As shown in FIG. 3, the key 42 has a longitudinal bore 60 terminating at a reduced tip 61 which is adapted to fit within the reduced cavity 62 of cap member 55. The opposite end portion of key 42 is provided with a pair of oppositely projecting bar elements 63, 63 to facilitate rotation of the key and has secured thereon a resilient bulb 64 provided with a conventional check valve 65, whereby air may be trapped in the bulb 64 and may be subsequently expelled through the tip 61 by squeezing the bulb. Thus, to raise the detent member 46, for example, to unlock the bolt 28 and release it for movement from the position thereof shown in FIG. 2, the key 42 is inserted through the sleeve 37 so as to engage its spline portion 43 with the splined central bore 35 of gear 33 with the tip 61 received in the recess 62. The bulb 64 is then squeezed so as to expel air through the tip 61 and through the conduit 56 into the lower portion of the cylinder 49, the vent plug 59 having been previously removed. By pumping sufficient air into the space beneath the piston 48 by means of the bulb 64, the piston can be elevated against the biasing force of spring 50 to thereby disengage the transverse bottom portion of the detent member 46 from the groove 44, allowing the pinion gear 33 to be rotated by means of key 42 so that the bolt 28 may be retracted from the socket 26. The bolt 28 may be retracted sufficiently so that the detent groove 45 moves below the detent member 46. After the door has swung open, the bolt 28 may be held in its retracted position and the key 42 may be removed, allowing the piston 48 to descend and thereby allowing detent member 46 to lockingly engage in the holding groove 45, thereby holding the bolt 28 in its retracted position.

As will be readily apparent, a similar unlocking action may be performed by energizing the solenoid 53 with the vent plug 59 removed, as above described. The energization of solenoid 53 raises plunger 52 and thereby disengages the detent member 46 from the locking groove 44, allowing the pinion gear 33 to be rotated by a splined key, such as the key 42, without requiring the use of an air bulb 64. The unlocking action by means of solenoid 53 may be remotely controlled, for example, by employing a radio receiver 66 mounted on the car whose output is connected to a relay 67 having a switch pole 68 and contacts 69, 69 connected in series with the solenoid 53 and a suitable battery 70, as shown in FIG. 6. A radio transmitter 71 located at a convenient central control point may be operated to furnish a radio signal receivable by the receiver 66 to thereby energize relay 67 and connect contact 69, 69 by means of the bridging relay pole 68. The solenoid 53 then becomes energized, raising the detent member 46 and allowing an authorized person to retract the bolt member 28 by means of a key 42 so as to allow the car door 23 to be opened. Furthermore, with the detent member 46 initially engaging in the detent groove 45, holding the bolt 28 retracted, the door 23 may be closed and may be then locked by a radio signal which energizes the solenoid 53, disengaging the detent member 46 from the holding groove 45 and allowing spring 29 to expand to extend the bolt 28 into the socket 26, after which the detent member 46 drops into the groove 44 under the biasing force of spring 50 with the radio signal discontinued.

The parts associated with the remote control of the solenoid 53, such as receiver 66, the relay 67, and the battery 70 and associated wiring may be contained in a suitable housing 72 mounted in the cavity 73 provided in the door 23 to receive the other associated parts of the anti-tampering bolt-locking mechanism.

Figure 7:
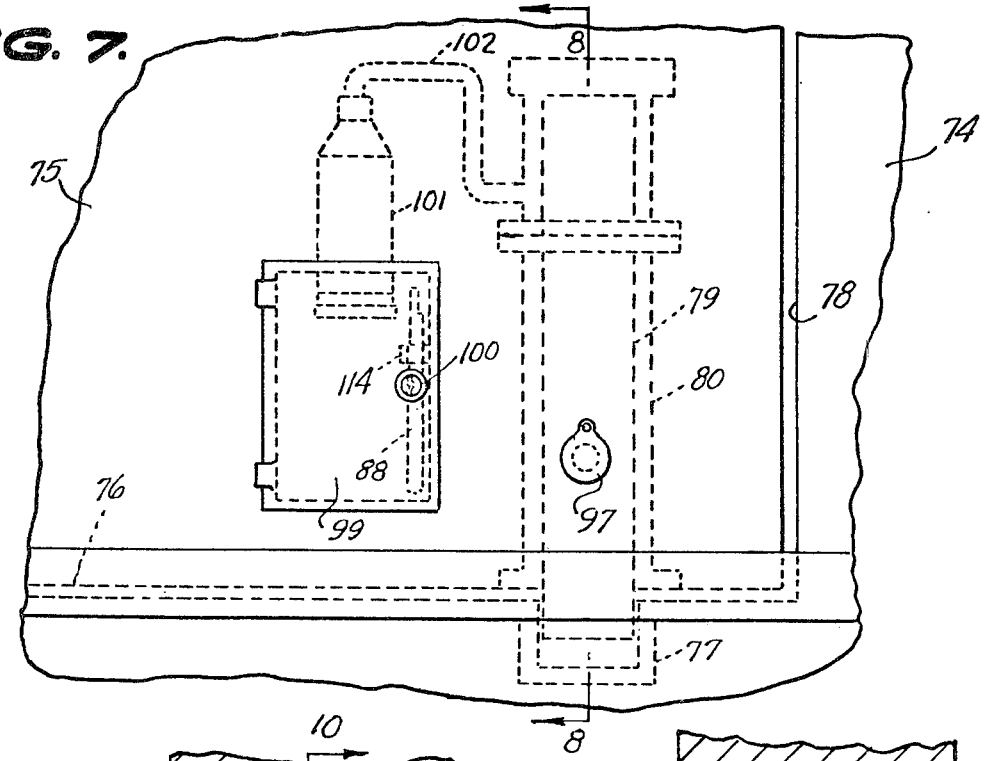
FIG. 7 is a fragmentary elevational view of the lower corner portion of a sliding freight car door and the portion of the associated doorway adjacent thereto, employing a modified form of anti-tampering door bolt locking device according to the present invention, the locking bolt being of the air pressure-operated type.
Figure 8:
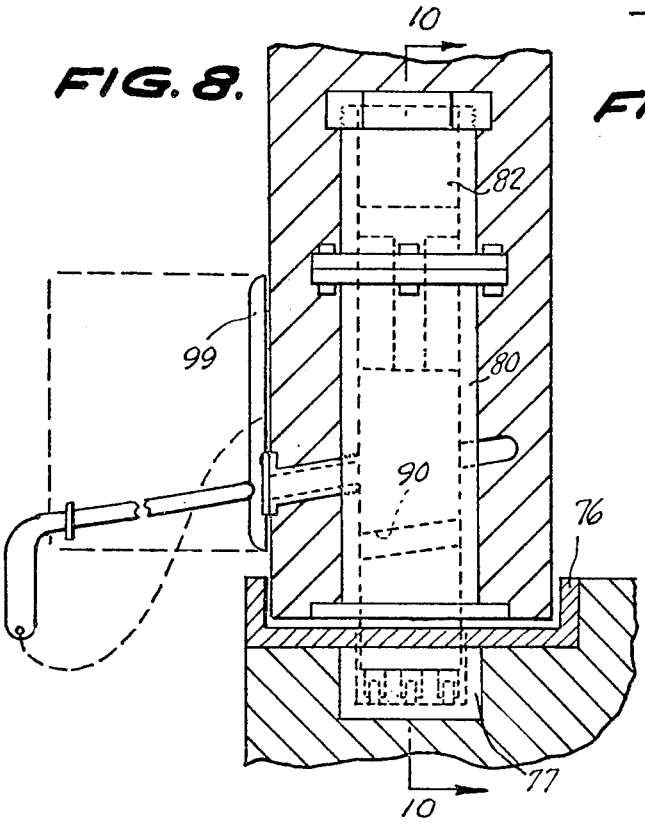
FIG. 8 is a vertical cross-sectional view taken substantially on the line 8—8 of FIG. 7, and showing a retaining pin which is employed to support the door locking bolt in an elevated position after the bolt has been elevated.

Referring now to FIGS. 7 through 17, 74 designates a freight car of the type provided with sliding doors 75, which are slidable in trackways 76 to open and close the doors. In the typical embodiment shown in FIG. 7, the trackway 76 is formed with a depressed locking cup 77 located adjacent the vertical side edge 78 of the associated doorway arranged to receive the lower end portion of a vertically slidable bolt member 79 mounted in a vertical housing 80 embedded in the door 75. Housing 80 is located so that when the door 75 is substantially closed, the bolt 79 will be vertically aligned with the locking cup 77 and can enter said cup in the manner shown in FIG. 10, the bolt 79 being biased downwardly toward locking position by a coil spring 81 mounted in a cylinder 82 secured to the top end of housing 80 and containing a piston 83 connected to the top end of bolt 79 by a vertical piston rod 84. Spring 81 bears between the suitably vented top cover cap 85 provided on the top end of cylinder 82 and the piston 83, whereby the spring 81 acts to urge the piston 83 downwardly and thus acts to bias the bolt 79 downwardly toward locking interengagement with the cup 77. The bottom end of the bolt 79 is provided with suitable rollers 87 adapted to make rolling contact with the bottom of the channel-shaped guide track 76 and to allow the door 75 to move along the track with spring 81 exerting downward biasing force on bolt 79, the bolt being allowed to descend into the locking cup 77 when it reaches said locking cup. Bolt 79 may be held in raised unlocking position by employing a supporting pin 88 which may be manually inserted through a guide tube 89 provided in the lower portion of door 75 and located so as to register with an inclined bore 90 provided in bolt 79, the guide tube 89 being similarly inclined. Thus, when the bolt 79 is in its raised position shown in FIG. 9, tube 89 registers with the inclined bore 90 of bolt 79 and the locking pin 88 may be inserted through the tube 89 and through the bore 90, the inner end of the locking pin being received in a suitably inclined recess 91 provided in door 75 in alignment with the tube 89 on the opposite side of housing 80. The pin 88 is provided with a handle 92 and a stop flange 93 limiting the insertion of the pin to the position thereof shown in FIG. 9. The handle 92 is connected to the interior of a storage compartment 94, presently to be described, and shown at 95, by a chain 96. Guide tube 89 is provided at its front end with a pivoted cover cap 97 which covers the front end of the guide tube under normal conditions, as shown in FIG. 7. As will be presently explained, the pin 88 is used to support the lock bolt 79 positively in a raised unlocking position. When the bolt 79 is raised, the pin 88 can be inserted through the sleeve 89 and through the bore 90 to engage in the recess 91 and thereby hold the bolt 79 elevated against the biasing force of the coil spring 81.

Bolt 79 may be provided with additional roller elements 98, such as roller bearings or the like, rotatably mounted in recesses in its vertical side walls, engagable with the inside surface of the guide housing 80 and minimizing the frictional resistance to movement vertically of the bolt 79 in the housing.

The auxiliary compartment 95 is embedded in the door 75 adjacent to the bolt housing 80, the compartment 95 being provided with a hinged front door 99 having a key controlled lock 100, whereby the door 99 cannot be opened unless a proper key is used in the lock 100.

Figure 10:
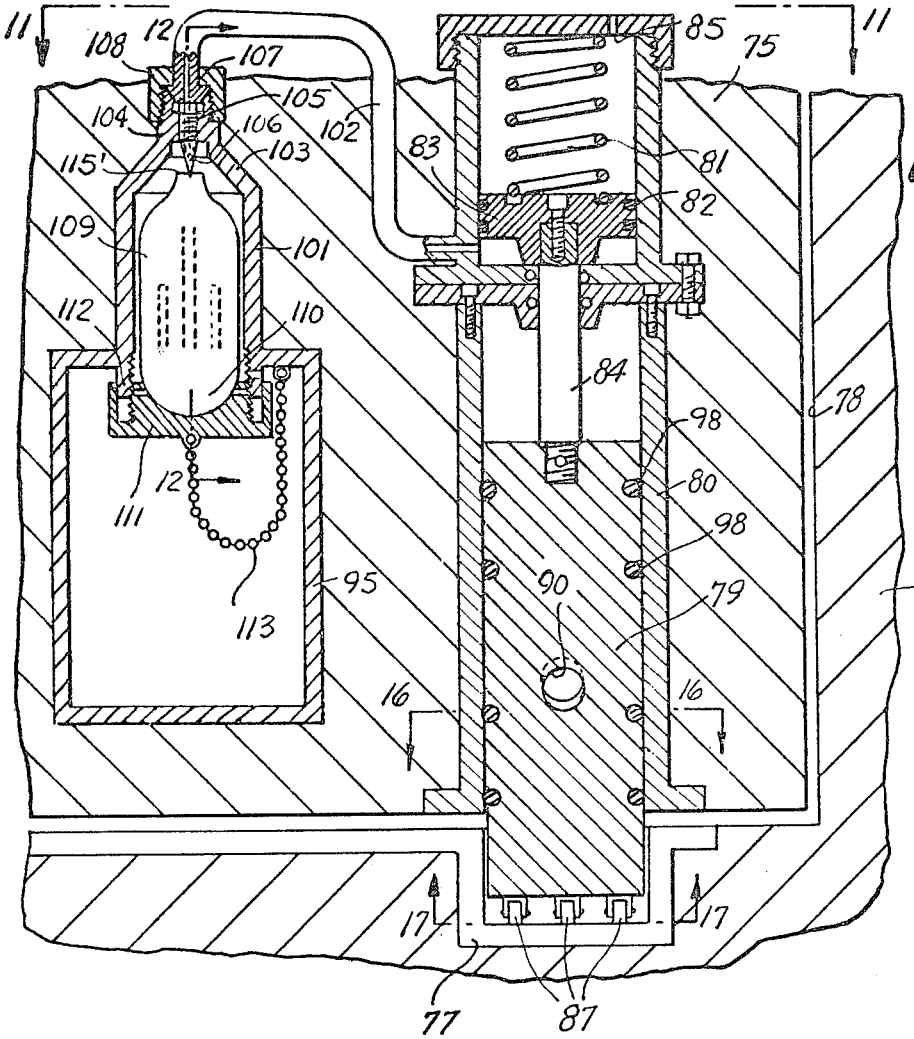
FIG. 10 is a vertical cross-sectional view taken substantially on line 10—10 of FIG. 8, showing the door bolt in its normal locking position.
Figure 11:
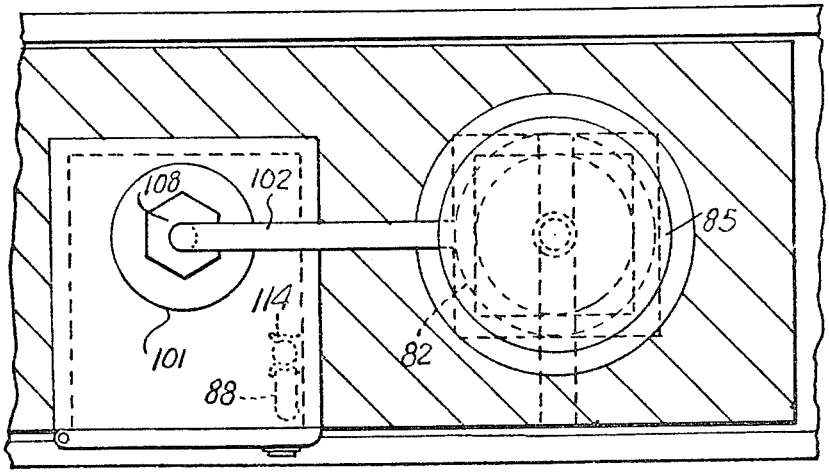
FIG. 11 is a horizontal cross-sectional view taken substantially on line 11—11 of FIG. 10.

The top wall of the compartment housing 95 is provided with an upstanding chamber 101 whose top end is connected by a conduit 102 to the space in the lower portion of cylinder 82 subjacent the piston 83, as shown in FIG. 10. Thus, the top portion of the chamber 101 is upwardly convergent, as shown at 103 and terminates in an upwardly extending neck portion 104 in which is threadedly engaged a conduit fitting 105 having a depending downwardly directed pointed bottom tip 106 which is suitably apertured to provide a passageway through the fitting. The conduit 102 is provided with a mating fitting 107 which is clampingly secured in communication with the fitting 105 by a union nut 108 threadedly engaged on the upper portion of the upstanding top element 104 of chamber 101.

The pointed tip 106 projects downwardly into chamber 101 and is normally adjacent the frangible top end of a compressed air bottle 109 engaged vertically in chamber 101 and having a hemispherical bottom end 110 which is normally supported in a conformably hemispherically recessed bottom cover 111 threadedly engaged with internal threads provided on a depending bottom skirt portion 112 forming a downward extension of the chamber 101, as is shown in FIG. 12. The cover 111 is connected to the top wall of the compartment housing 95 by a chain 113 to prevent loss of the cover.

The pin 88 is normally stored in the storage compartment 95, suitable clips 114 being provided therein to support the pin.

When it is desired to unlock the door 75, a person having the proper key inserts same in the lock 100 and opens the door 99. With the door open, the authorized person reaches into the compartment 95 and rotates the bottom cap member 111 in a direction so as to elevate the bottle 109 and cause its top wall portion, shown at 115' in FIG. 12, to be pierced by the pointed tip 106, whereby the compressed gas escapes from the container 109 and passes through conduit 102 to the space in cylinder 82 beneath piston 83, raising the piston and thereby raising the bolt 79 out of the locking cup 77. The bolt 79 may then be retained in raised unlocking position by inserting the supporting pin 88 through the sleeve 89 and through the bore 90, which is then in registry with said sleeve, the inner end of the pin 88 entering the recess 91. The bolt 79 will thereafter be supported in its elevated position, allowing the freight car door 75 to be opened so as to allow access to the interior of the freight car. The bolt 79 will be supported in its elevated unlocking position until the pin 88 is subsequently withdrawn from the guide sleeve 89, for example, when it is desired to relock the freight car door.

Suitable means are provided to hold the compressed gas container 109 against rotation while the bottom cap member is rotated. Thus, the bottle 109 may be provided with a plurality of vertical grooves 115 slidably interengagable with inwardly projecting vertical spline ribs 116 provided on the inner wall surface of chamber 101, allowing vertical movement of the container 109 in the chamber 101 but preventing the container 109 from rotating relative to said chamber. Thus, FIGS. 12, 13 and 14 illustrate the use of three grooves 115 on the container 109, with corresponding ribs 116 provided on the interior wall of chamber 101. Alternatively, as shown in FIG. 15, the container 109 may be provided with a single vertical groove 115 adapted to slidably receive a single vertical rib 116 provided on the interior surface of the chamber 101.

FIGS. 12, 13, 14 and 15 may be considered as representing three different compressed air cartridge designs. Thus, the design of FIGS. 12 and 13 may be made for specific use with freight cars, the design of FIG. 14 may be somewhat modified so that it is used specifically with trailer truck doors, and the design of FIG. 15 may be made for specific use with air cargo vehicle doors.

The cartridges may contain small quantities of lubricant, such as oil, graphite, or any other suitable type of lubricant, serving to maintain the associated pistons and cylinders properly lubricated. When the cartridges are pierced, in the manner above described, the compressed air or gas escapes from the cartridges and carries the lubricant along with it to the surfaces of the associated pistons and cylinders.

As shown in FIG. 12, the bottom cover cap 111 may be provided with a suitably vented external skirt portion 118 having a vent hole 119, and the seat of the cap may be communicatively vented to the space inwardly adjacent skirt portion 118 by a vent passage 120. The lower portion of the depending flange element 112 is likewise provided with vent passages 121 arranged so as to release the pressure inside the chamber 101 shortly before the cap 111 is detached from the member 112, for example, to replace the empty receptacle 109 with a new sealed receptacle.

Figure 9:
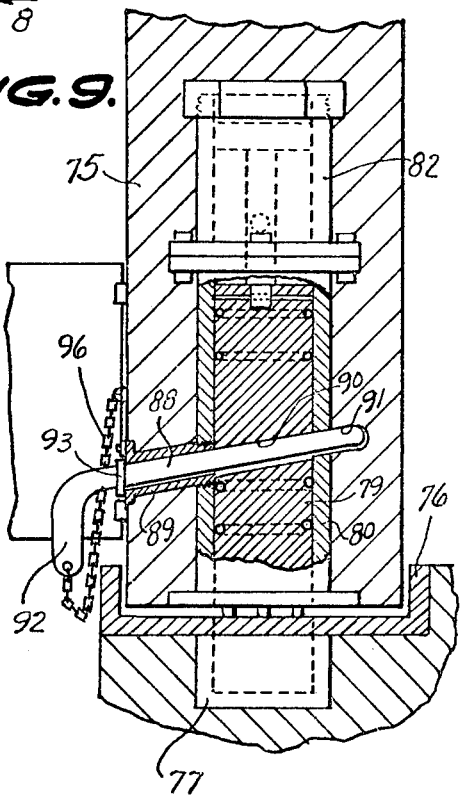
FIG. 9 is a cross-sectional view similar to FIG. 8 but showing the bolt-retaining pin in operative position to support the door bolt in its elevated unlocking position.

As will be understood from the above explanation, the car door 75 may be held unlocked by means of the pin 88 and the engagement thereof with the bolt 79 in the manner shown in FIG. 9, while the receptacle 109 is being replaced. After this replacement has been made and it is desired to again lock the car door, the pin 88 is withdrawn and replaced in the compartment 95, releasing the bolt 79. The door 99 may then be relocked until it is again desired to open the freight car door 75, namely, to elevate the bolt 79 from its locking position in the locking cup 77.

As above-mentioned, the compressed gas receptacle 109 is generally bottle-shaped, and is shaped so as to substantially slidably fit in the chamber 101. As mentioned above, in inserting the gas container 109, it is rotated, for example, from the position thereof shown in FIG. 14, to a position wherein the grooves 115 will be aligned with the ribs 116, after which the receptacle can be slid upwardly into the chamber 101 and the bottom cover 111 can be threadedly engaged with the lower end portion to bring it into the position thereof shown in FIG. 12, wherein the container 109 is supported with its frangible top wall portion 115' located just below the pointed tip 106.

The same procedure is employed where the container is provided with only one groove 115 and the chamber 101 is provided with only one rib 116, as in FIG. 15.

From FIG. 12 it will be seen that when the bottom cover 111 is rotated to raise the container 109 to the dotted view position thereof shown in FIG. 12, the pointed tip 106 will penetrate through the frangible top wall portion 115' and the compressed gas from the container 109 will then pass into the fitting 105, and from thence through the fitting 107 and the conduit 102 to the space in cylinder 82 below the piston 83. The bolt 79 will be elevated to its raised unlocking position and will be held therein as long as piston 83 is kept in its raised position against the opposing force of the spring 81. Since some leakage will occur, it is necessary to employ the retaining pin 88 in the manner above-described in order to maintain the bolt 79 raised for any substantial period of time. Also the use of pin 88 enables the bottom cap 111 to be unscrewed for replacing the compressed gas container 109 without causing the bolt 79 to drop to its locking position.

Referring now to FIGS. 18 and 19, 130 generally designates a freight car having a suspended sliding door 131 supported by rollers 132 engaging a conventional trackway 133 provided at the top portion of the car. Secured to the top margin of the door 131 is a bracket 134 having an outwardly extending horizontal flange 135 provided with a locking opening 136. Mounted on the top portion 130 of the car overlying the bracket 134 is a vertical air cylinder 137 provided with a piston 138 biased downwardly by a coil spring 139 bearing between piston 138 and an adjustable spring seat 140. As shown in FIG. 19, the top spring bearing seat 140 is rotatably connected to an adjusting screw 141 threadedly engaged through a central boss 142 provided on the top cover cap 143 of cylinder 137. The biasing spring pressure on the piston 138 may be adjusted by rotating the screw 141, whereby to either raise or lower the spring bearing seat 140.

Rigidly secured axially to the piston 138 is a depending bolt rod 144 which is located so as to be engagable in the locking opening 136 of bracket flange 135 in the manner illustrated in FIG. 19. Bolt 144 is biased downwardly by the action of spring 139, and is thus biased toward locking position. The flange bracket 135 has an inclined forward portion 145 along which the bolt 144 can ride while the door 131 is moved rightwardly, as viewed in FIG. 18, toward its locked position shown therein.

The top cover 143 is suitably vented, as shown at 147, to allow piston 138 to move freely upwardly and downwardly in cylinder 137.

The lower end portion of cylinder 137 is connected by a compressed air supply conduit 148 through a pressure-responsive valve 149 and a manually-controlled valve 150 to a air pressure line 151 leading to a suitable controllable air pressure source, such as a compressed air cartridge. Line 151 may comprise a connection to the normal air brake lines which are normally at nominal pressure, for example, seventy pounds per square inch, whereas the pressure-responsive valve 149 is adapted to remain closed unless a substantially higher pressure is present at its inlet side, for example, a pressure of 140 pounds per square inch. The source of air pressure connected to line 151, such as a compressed air cartridge, may be arranged to provide the necessary relatively high pressure required to open valve 149, and said higher pressure is applied to line 149 when it is desired to unlock the car door 131. Thus, with valve 150 open and the aforesaid higher pressure connected to line 151, the pressure air will pass through the valve 149 and enter the lower portion of cylinder 137, raising piston 138 and retracting bolt 144 from aperture 136. This allows the door 131 to be opened to provide access to the contents of the car.

As will be readily apparent, the various freight cars of the system may be simultaneously controlled in the manner above described, since their door-opening cylinders 137 may be all connected to the common brake line by means of the conduit 151 thereof. This permits all of the doors of the train to be simultaneously unlocked, or those selected to be unlocked by the opening of their manually controlled valves 150.

When the air pressure at the source is reduced to the normal brake line value, namely, seventy pounds per square inch, the pressure-responsive valve 149 closes, and after a short period of time, due to leakage in the cylinder 137, the piston 138 descends under the biasing force exerted thereon by spring 139, lowering the bolt 144 to its locking position. The same can be accomplished by closing the valve 150. With the bolt 144 lowered, the door 131 can be moved rightwardly from its open position to the closed position thereof shown in FIG. 18, wherein the bolt 144 is lockingly engaged in the locking aperture 136 of the associated bracket 134.

FIG. 20 illustrates an embodiment wherein a sliding freight car door 160 is provided with a cavity in its vertical edge in which is secured a housing 161 opening at said vertical edge and being substantially registrable with an opposing housing 162 secured in a recess provided in the mating vertical edge of the associated doorway of the car 163. Pivotally mounted on a transverse pivot pin 164 secured in housing 161 is a weighted locking lever 165 provided with a locking hook element 166, with a weight portion 167 formed integrally on the lever adjacent the hook portion 166 so as to bias the lever in a clockwise direction, as viewed in FIG. 20. The hook 166 has a beveled edge 168 which is cammingly engagable with a corresponding beveled edge 169 provided on a transverse locking detent member 170 secured in the lower portion of housing 162. A transverse stop pin 170' is provided in housing 161 which is engagable in a recess 171 provided on the inwardly extending arm 172 of lever 165 to limit clockwise rotation of lever 165, as viewed in FIG. 20, to the locking position thereof shown therein. Another transverse stop pin 173 is provided in housing 161, spaced upwardly from the locking position of lever 165, to limit counterclockwise rotation of the lever, for example, to limit such rotation to the dotted view position thereof, as shown in FIG. 20.

The inner arm portion 172 of lever 165 is concavely formed at its top edge, as shown at 174, to engage with the rounded lower end of a depending piston rod 175 carried by a piston 176 contained in a cylinder 177 secured in the top portion of housing 161, the piston being biased upwardly by a coil spring 178 bearing between piston 176 and the bottom wall of cylinder 177, as is clearly shown in FIG. 20. The cylinder 177 is provided with a top cover cap 179 to which is connected an air supply conduit 148 in an air supply system similar to that shown in FIG. 18. Thus, with the piston 176 elevated, as shown in FIG. 20, the door 160 may be moved rightwardly to cause the hook 166 to become lockingly engaged with the detent element 170, whereby the door is locked, the lever 165 being retained in locking position by the biasing action of its weight portion 167. To unlock the door it is necessary to admit air pressure into the top end of cylinder 177 through the supply conduit 148, whereby the piston rod 175 is caused to descend, rotating the lever 165 counterclockwise to the dotted view position thereof shown in FIG. 20, thereby releasing the door and allowing it to be opened.

FIGS. 21 and 22 show another embodiment of the present invention, wherein the vertical free marginal edge portion of the sliding door 180 has a recess 181 in which is secured a suitable bracket 182 to which are connected a pair of vertically aligned eye bolts 183, 183 having external eye rings 184 extending from the edge 185 of the door, the eye loops 184, 184 being vertically aligned, as shown in FIG. 21. A housing 186 is secured in the vertical edge portion 187 of the associated doorway, the housing having spaced horizontal slots 188, 188 through which the eye loops 184, 184 may pass as the door 180 is moved to closed position, such as that shown in FIG. 21. Secured to the inner vertical wall of housing 186 opposite the slots 188 is an eye bolt 189 having an eye loop 190 which is located so as to be received between the eye loops 184, 184 substantially in registry therewith when the door 180 is moved to its closed position, such as that illustrated in FIG. 21. Mounted in the top portion of housing 186 is a cylinder 191 containing a piston 192 biased downwardly by a coil spring 193 bearing between the top cap 194 of the cylinder and said piston. Axially secured to the piston 192 is a piston rod 195 which is receivable in the aligned eye loops 184, 190 and 184, as shown in FIG. 21. A supply conduit 148 similar to that employed in FIGS. 20 and 18, is connected to the bottom portion of cylinder 191. Thus, the door may be unlocked by admitting pressure fluid into the lower portion of the cylinder 191 through the conduit 148, whereby to elevate piston 192 and raise piston rod 195 so that it disengages from the aligned eye loops 184, 190, 184 of FIG. 21. With the piston 192 thus elevated, the door 180 may be moved leftwardly from the position thereof shown in FIGS. 21 and 22 and may therefore be opened to provide access to the interior of the associated freight car. Conversely, to lock the door, the piston 192 is first elevated by admitting pressure air into the cylinder 191 through the conduit 148 to thereby raise the piston rod 195, after which the door is closed, moving the eye loops 184, 184 above and below and in alignment with the eye loop 190, whereupon the supply of fluid under pressure to the conduit 148 is cut off and the conduit may be suitably vented to allow the spring 193 to push the piston 192 downwardly towards its locking lowered position. As conduit 148 is vented, piston 192 will descend immediately. Otherwise, piston 192 will descend as soon as the air thereunder has leaked past the piston and escaped through the upper portion of cylinder 191.

While certain specific embodiments of a freight car door locking structure have been disclosed in the foregoing description, it will be understood that various modifications within the spirit of the invention may occur to those skilled in the art. Therefore, it is intended that no limitations be placed on the invention except as defined by the scope of the appended claims.

What is claimed is:

1. In a freight vehicle having a doorway, a door movably mounted on the vehicle for opening and closing said doorway, said door having a portion movable adjacent a portion of the doorway when the door is closed, co-operating bolt and detent means respectively mounted on said portions for at times locking the door in closed position, said bolt means including an air pressure cylinder and a movable bolt member mounted on one of said portions, said cylinder having a movable piston therein, bolt-restraining means coupled to said piston, said detent means comprising a detent element mounted on the other portion and being lockingly engagable by said bolt means, means to at times admit pressure air into said cylinder, wherein said bolt means comprises a bolt slidably mounted on said door portion, and wherein said detent means comprises a socket element on said doorway portion located to receive said bolt, an air chamber on said door, conduit means communicatively connecting said chamber to said cylinder for admitting pressure air to said cylinder, a normally sealed pressure air container in said chamber, means for changing the position of said container in said chamber, and means to unseal said container responsive to a change of position of said container in said chamber.

2. The freight vehicle of claim 1, and wherein the top of said chamber is provided with a depending pointed hollow nozzle element communicating with said conduit means and said container has a frangible top end below said nozzle element, defining said unsealing means, said chamber having a threaded bottom cap underlying the container for moving said container upwardly responsive to rotation of said bottom cap and comprising said position-changing means, whereby to cause said nozzle element to perforate said frangible top end.

3. The freight vehicle of claim 1, and wherein one end of said chamber is provided with an inwardly directed pointed hollow nozzle element communicating with said conduit means and said container has a frangible end portion adjacent said nozzle element, defining said unsealing means, said chamber having a cap member threadedly engaging its other end and comprising said position-changing means, said cap member engaging the container so as to move said container in a direction to cause said nozzle element to perforate said frangible end portion responsive to rotation of said cap member.

4. The freight vehicle of claim 3, and wherein said chamber and container have interengaging longitudinal spline portions to hold the container against rotation in the chamber.

5. The freight vehicle of claim 4, and said bolt-restraining means including means biasing said bolt toward extended position, and manually activated means to at times hold the bolt against movement after it has been retracted.

6. The freight vehicle of claim 5, and wherein said manually activated means comprises a retaining pin engagable through the door and through said bolt when the bolt is in its retracted position.

7. The freight vehicle of claim 1, and wherein said normally sealed pressure container contains a small quantity of lubricant as well as compressed air, the lubricant being of a type which can be carried along with the escaping compressed air when the container is unsealed.

* * * * *